United States Patent [19]

Lalancette et al.

[11] Patent Number: 4,886,591

[45] Date of Patent: Dec. 12, 1989

[54] PHOSPHATE BONDED COMPOSITE ELECTRODES

[75] Inventors: Jean-Marc Lalancette; Hugues Menard; Estelle Potvin, all of Sherbrooke, Canada

[73] Assignee: Universite De Sherbrooke, Sherbrooke, Canada

[21] Appl. No.: 228,328

[22] Filed: Aug. 4, 1988

[51] Int. Cl.[4] ..... C25B 11/04

[52] U.S. Cl. ..... 204/291; 204/292

[58] Field of Search ..... 204/291, 292, 293; 502/324

[56] References Cited

U.S. PATENT DOCUMENTS 4,769,074 9/1988 Holcombe, Jr. et al. ..... 252/506

FOREIGN PATENT DOCUMENTS 0087433 7/1981 Japan ..... 502/324

*Primary Examiner*—John F. Niebling
*Assistant Examiner*—Kathryn Gorgos
*Attorney, Agent, or Firm*—Dressler, Goldsmith, Shore, Sutker & Milnamow, Ltd.

[57] ABSTRACT

A pressure-molded, rigid, high surface cathodic or anodic electrode of low electrical resistance and good mechanical strength and resistance to corrosion comprising non-dissolving, electrically-conducting metal particles of high specific surfaces and fractal structure which are bound with up to 15% by weight of aluminum phosphate.

5 Claims, No Drawings

PHOSPHATE BONDED COMPOSITE ELECTRODES

BACKGROUND OF THE INVENTION

The present invention relates to composite electrodes having improved electrical performances along with good mechanical properties and resistance to aggressive reagents currently being used in the course of electrochemical processes.

Electrochemical processes take place at the surface of electrodes. A very fundamental concept in electrochemistry is the overvoltage or electrical overpotential that must be applied between two electrodes to generate a given electrochemical reaction. The potential of an electrode having a zero-current value is named the equilibrium or standard potential ($E_o$). When practical applications are contemplated for an electrochemical process, the desired end compound can be produced by the application of a high current density. The voltage that must be applied accross the cell to induce useful values of current through the cell is substantially higher than the equilibrium potential. The difference between the actual potential at high current density and the equilibrium potential is designated as the overpotential. Depending on the system used and the intensity of the current, the overpotential can vary from a few millivolts to several hundreds of millivolts of the equilibrium poential.

It will be readily understood that the existence of an overpotential represents an energy loss and great efforts have been applied to reduce as much as possible the voltage above the standard potential $E_o$ which is required to drive an electrochemical system at a practical rate.

The existence of an overpotential is a complex phenomenon but has been noted that the overpotential generally increases as the current density, that is the number of amperes per square centimeter, increases. An obvious measure to decrease the overpotential would therefore consist in increasing the surface of the electrode in order to reduce this current density. Divided particles can be generated with high specific surfaces. If a section of one square cm on an electrode is covered with fine conducting particles, the actual surface offered to the reaction can be as high as one square meter, thus increasing the available surface by a factor of 10,000. Although not all of this surface is available for electrochemical processes, there is a substantial gain from the polished surface. A roughness on the surface of the electrode, such roughness being defined as the ratio of its actual surface to its geometric area, is therefore a good way of decreasing the overpotential by reduction of the current density.

There are many techniques which are well known for preparing electrodes having high specific surfaces. Amongst the known techniques, there may be mentioned plasma-spray, sputtering of metallic powders, electrodeposition and codeposition of material that can later be leached out of the catalyst, gas diffusion electrodes, sintering of metallic powders coated on a substrate and use of a packed-bed flow reactor with metallic powders.

Notwithstanding that the prior art does teach the preparation of high surface electrodes, the prior art procedures also require a fairly large amount of binder when electrodes are shaped from particulate matter, which results in a decrease of surface area with the consequence that an increase in electrical resistance is the end result.

Accordingly, it would be highly desirable if high surface electrodes could be devised whereby the use of the binder of particulate substrate would be reduced to a minimum thus increasing the available surface area for a given amount of material with corresponding advantages, the main one being a substantial reduction in electrical resistance due to an increase in conductivity.

SUMMARY OF THE INVENTION

In accordance with the present invention, there is now provided a rigid high specific surface cathodic or anodic electrode in which non-dissolving conductive metal particles of high specific surfaces are bound with up to 15% by weight of aluminum phosphate as a binder.

The non-dissolving conductive particles may be any of those formed from a material used normally as catalyst since the catalytic action is usually associated with a high specific surface of the particles.

The binder used in the present invention is an acid aluminum phosphate or monoaluminum phosphate.

The shaping of the electrodes of the present invention is made by hot molding under pressure. This technique when used with appropriate binder leads to the formation of electrodes with reproducible properties.

DETAILED DESCRIPTION OF THE INVENTION

Particles

The present invention relates to non-dissolving electrodes. Any conducting particle having the appropriate specific surface and which is not substantially dissolved in the course of the electrolytical process by complexing or change of valency mechanisms is appropriate as a substrate for the production of electrodes. This includes metals, carbides, borides or nitrides compatible with the solvent used in the electrolytical process. The specific surface area of the conducting particles can vary from 0.05 $m^2/g$ to 50 $m^2/g$ (BET) and the size of particle agregates from 800 $\mu m$ to 2 $\mu m$. The shape of the particles has been found to be of great significance when related to electrochemical and mechanical performances. In some instances, upon examination with electron microscope, the particles presented an aspect ratio (l/d) of less than 5. With such particles, a higher percentage of binder was required to obtain good mechanical strength. On the other hand, in the course of the preparation of conducting particles, processes allowing cristal growth with fractal configuration are highly desirable. Besides having high specific area, such materials require much less binder to attain good mechanical strength and lead to electrodes with improved mechanical inertness. This point is well illustrated with nickel. Particles obtained by pyrolysis of nickel carbonyl showed a highly ramified structure typical of fractal and could be bonded with as little as 2% by weight of aluminum phosphate. The resulting electrode was showing good mechanical strength and excellent resistance to corrosion after one month in the presence of concentrated alkaline solution (6M NaOH) at high temperature (70° C). With more spherical granule of nickel (l/d ratio of $\approx 1$) even with much more binder (15%), the chemical resistance to hot concentrated alkali was essentially lost.

Therefore, although conducting particles of low aspect ratio can be shaped with aluminum phosphate into useful electrodes, arborescent granules typical of fractal structures and having high specific area are highly desirable to give all the advantages of the present invention.

Binder

The binding agent is an acid aluminum which is combined in situ with a source of alumina. This class of compounds is prepared by the reaction of alumina or aluminum hydroxide with phosphoric acid at temperature around 100° C. For the purpose of the present invention, the aluminum to phosphorus ratio can vary from 0.66 to 0.30 with a preferred value of 0.33, corresponding to monoaluminum phosphate: $Al(H_2PO_4)_3$. The advantage of using monoaluminum phosphate is that it can be dried at 150° C. without undue polymerization. It can then react further with alumina or a source thereof such as $Al(OH)_3$, in the presence of the conducting particle to give the binding aluminum phosphate. The formation of acid aluminum phosphate and its transformation into aluminum phosphate is illustrated by the following equations: $\frac{1}{2}Al_2O_3+3H_3PO_4+Al(H_2PO_4)_3+3/2H_2O$ and $Al(H_2PO_4)_3+2Al(OH)_3 \rightarrow 3AlPO_4+6H_2O$.

Shaping of the electrode

The shaping of the electrode is done by preparing a homogeneous mixture of the conducting particles, the binder (for example $Al(H_2PO_4)_3$) and alumina. Anhydrous conditions must be used in the course of the preparation of this mixture since the monoaluminum phosphate is very hygroscopic. The shaping is done in an evacuated mould under a pressure of 700 kg/cm$^2$ for a period of 10 minutes at a temperature of 25° to 100° C. The shaping is followed by a curing of 3 hours at 400° C. The electrode is then ready for use. The following Table illustrates the typical properties of electrodes prepared by using this technique.

TABLE I

THE SHAPING OF ELECTRODES

| | PARTICLES | | | BINDER | | | | ELECTRODES | | |
|---|---|---|---|---|---|---|---|---|---|---|
| Examples | % | Size | Surface area (m$^2$/g) | Nature | % | Nature | Chemical resist. | Electrical conductivity | Surface area cm$^2$ | Overpotential of Hydrogen mV* |
| 1 | 98 | ≦38 μm | ~0.6 | Ni Fractal | 2 | $AlPO_4$ | Insol. | $8.9 \times 10^{-5}$ Ωcm | 1.33 | −113 |
| 2 | 90 | ≦38 μm | ~0.6 | Ni Fractal | 10 | $AlPO_4$ | Insol. | $\sim 2.4 \times 10^{-4}$ Ωcm | 1.33 | −230 |
| 3 | 80 | ≦38 μm | ~0.6 | Ni Fractal | 20 | $AlPO_4$ | Slightly Soluble | $1.5 \times 10^{-4}$ Ωcm | 1.33 | −240 |
| 4 | 70 | ≦38 μm | ~0.6 | Ni Fractal | 30 | $AlPO_4$ | Soluble | $2.4 \times 10^{-4}$ Ωcm | 1.33 | — |
| 5 | 60 | ≦38 μm | ~0.6 | Ni Fractal | 40 | $AlPO_4$ | Soluble | $1.35 \times 10^{-3}$ Ωcm | 1.33 | — |
| 6 | 95 | ≦38 μm | ~0.6 | Ni Fractal | 3 | $AlPO_4$ | Insol. | — | 1.33 | −180 |
| | 2 | ≦38 μm | — | Al | | | | | | |
| 7 | 96 | ≦38 μm | ~0.6 | Ni Fractal | 3 | $AlPO_4$ | Insol. | — | 1.33 | −203 |
| | 1 | ≦38 μm | — | NaCl | | | | | | |
| 8 | 98 | ≦38 μm | — | Co | 2 | $AlPO_4$ | Insol. | $2.5 \times 10^{-3}$ Ωcm | 1.33 | −400 |
| 9 | 98 | ≦38 μm | — | Cu | 2 | $AlPO_4$ | Insol. | | 1.33 | −431 |
| 10 | 95 | ≦38 μm | — | Pt | 5 | $AlPO_4$ | Insol. | — | 0.50 | −25 |

*For solution of KOH 1.0M at 25° C. and corrected for ohmic drop by the linear regression program for a current of 250 mA/cm$^2$. [R. L. Leroy, M. B. I. Janjua, R. Renaud and U. Leuenberger J. Electrochem. Soc. 126, 10 p. 1674,(1979).]

Uses of the invention

The invention has been particularly useful in producing composite electrodes of high specificity area, with particulate material that could be agglomerated only with difficulty, prior to the use of aluminum phosphate as binder. Along with its electrical and mechanical properties, the electrodes' relative inertness to agressive chemicals is very interesting.

Such composite electrodes have been used for the production of hydrogen by electrolysis of water, with low overpotential and good resistance in the alkali. Also, oxygen, chlorine and other anodic species can be produced from these phosphate bonded composite electrodes, thus confirming their usefulness either as anode or cathode.

Implementation of the invention

Electrochemical measurements for hydrogen evolution are made with electrochemical glass cell having two compartments separated by a fritted glass and thermostated at 25°. Experiences are made at 25° C. in KOH 1M aqueous solution deaerated 30 min with nitrogen. The working electrode has a geometrical surface area of 1.33 cm$^2$ and is fixed in a vertical position. The auxiliary electrode is a carbon rod. The Hg/HgO reference electrode is outside the cell and is connected by a Luggin capillary fixed at 0.5 mm of the working electrode. The hydrogen reversible potential on platinum electrode in that solution is −927 mV compared to the mercury electrode Hg/HgO.

The electrode polarization for hydrogen and oxygen evolution was made by imposition of a constant decreased current stepwise from 250 mA to 0.02 μA with potentiostat-galvanostat PAR, model 273. The Tafel plot was corrected for ohmic drop with a linear regression program (R. L. Leroy, M. B. I. Janjua, R. Renaud and J. Levenberger. J. Electrochem. Soc. 126, 10 p. 1674, 1979).

The following example is given to illustrate the scope rather than limit the present invention.

EXAMPLE 1

Nickel particles produced by Nickel carbonyl pyrolysis were used. These particles had a fractal structure. The l/d ratio was ~15. They were sifted with a sifter of 38 μm; so, they had a length of ≦38 μm. Scanning electronic microscopy was used to identify the size and the morphology of particles.

Aluminum acid phosphate $Al(H_2PO_4)_3$ was synthetized by heating 31.8 g of $H_3PO_4$ 85% with 5.1 g of $Al_2O_3$ previously heated for 24 hours at 500° C. A Teflon ® cell was used as reactor. The reactor was slowly heated externally in a waterbath at boiling temperature while stirring constantly the reacting mass.

An exothermic reaction occurs after 10 minutes and the temperature rises to 130° C. After about 20 minutes, the temperature dropped to 97° C. The cell was heated in an oven at 150° C. for 6 to 24 hours. The $Al(H_2PO_4)_3$ formed was then crushed in a blender and sifted through the fine particle sifter.

The $Al(H_2PO_4)_3$ is very hygroscopic. It must not at anytime during the manipulation come in contact with an atmospheric humidity over 4%. If necessary, a glove box can be used. The $Al(H_2PO_4)_3$ sifted at 100 μm is kept in a dessicator. For the formation of polymerized $AlPO_4$ binder, we use $Al(OH)_3$ sifted at 38 μm.

The nickel electrode was made with a mixture of 1.4700 g of nickel (sifted at −38 μm), 0.0099 g of $Al(OH)_3$ (sifted at −38 μm) and 0.0201 g of $Al(H_2PO_4)_3$ (sifted at −100 μm). This composition corresponds to 2% of polymer and 98% of nickel. The mixture was then crushed with a mortar and pressed in a stainless steel mold of 1.30 cm in diameter with a pressure of 1400 kg/cm$^2$ for a period of 10 min. The temperature was maintained at 25° C. and a vacuum was applied in the mold.

The electrode obtained was 3.5 mm thick and was immediately heated at 400° C. under argon atmosphere for a period of 3 hours to permit a very good polymerization by water evaporation.

Epoxy glue was spread on back and sides of the electrode in order to delimit a working area of 1.33 cm$^2$.

The electrodes were tested as hydrogen cathodes in a 1.0M aqueous KOH solution at 25° C. The Tafel plot was recorded (and corrected for the ohmic drop) from which the hydrogen overvoltage for a current of 250 mA/cm$^2$ was calculated, −113 mV.

We claim:

1. A pressure-molded, rigid, high surface cathodic or anodic electrode of low electrical resistance and good mechanical strength and resistance to corrosion comprising non-dissolving, electrically-conducting metal particles of high specific surfaces and fractal structure which are bound with from 2 to 15% by weight of aluminum phosphate.

2. An electrode as in claim 1 where the electrically conducting particles have a specific surface of 0.05 m$^2$/g to 50 m$^2$/g and a particle size of 800 μm to 2 μm.

3. An electrode as in claim 1 where the binder is a monoaluminum phosphate in the presence of alumina with a Al to P ratio of 0.66 to 0.30.

4. An electrode as in claim 1 where the particles to binder ratio varies from 99/1 to 70/30 and where particles are selected from non-dissolving metals, carbides, borides or nitrides.

5. An electrode as in claim 1 where the binder is a monoaluminum phosphate in the presence of alumina with a Al to P ratio of 0.33.

* * * * *